United States Patent [19]

Corbett

[11] 4,269,203

[45] May 26, 1981

[54] ANTI-SMOKING DEVICE

[76] Inventor: Lacey O. Corbett, 208 Sandwich St., Plymouth, Mass. 02630

[21] Appl. No.: 121,719

[22] Filed: Feb. 15, 1980

[51] Int. Cl.[3] ..... A24F 47/00

[52] U.S. Cl. ..... 131/270

[58] Field of Search ..... 131/170 A, 170 R, 171 A, 131/8 R, 10.1, 261 A

[56] References Cited

U.S. PATENT DOCUMENTS 4,054,146 10/1977 Ortiz ..... 131/170 R

FOREIGN PATENT DOCUMENTS 598006 5/1960 Canada ..... 131/10.1

1270933 7/1961 France ..... 131/10.1

*Primary Examiner*—Stephen C. Pellegrino

*Attorney, Agent, or Firm*—Norman S. Blodgett; Gerry A. Blodgett

[57] ABSTRACT

A device for injecting an unpleasant odiferous substance into cigarettes contained within a package includes a hollow carrying case with an upper chamber for receiving a package of cigarettes and a lower chamber containing the odiferous substance. Hollow needles are arranged to extend from the lower chamber into the upper chamber for penetration into the cigarettes.

12 Claims, 6 Drawing Figures

FIG. 4
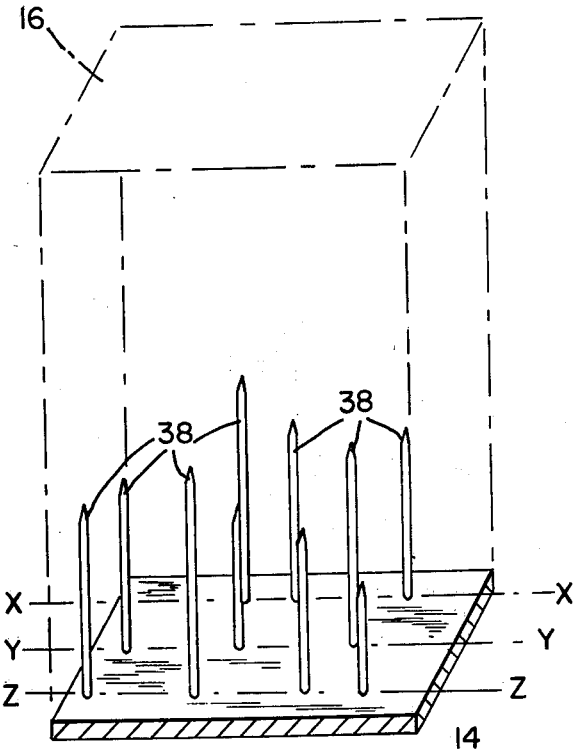
FIG. 5
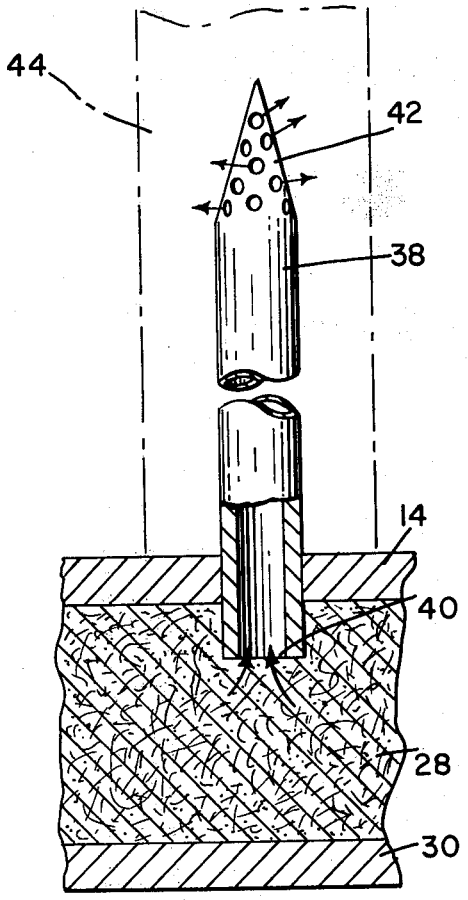
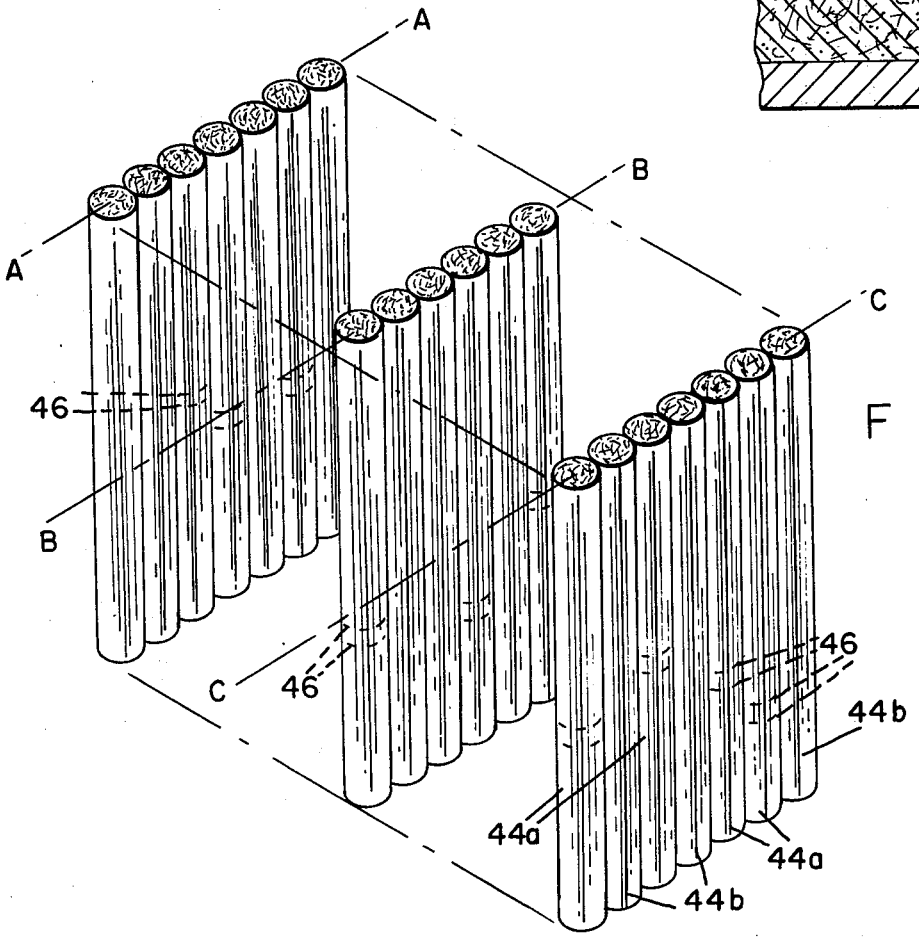
FIG. 6

ANTI-SMOKING DEVICE

BACKGROUND OF THE INVENTION

A growing number of persons who regularly smoke cigarettes have a sincere desire to abstain from smoking, but are unable to do so. Although there are many aids and programs designed to overcome the smoker's physical or psychological addiction to smoking, a very small percentage of smokers are successful in completely overcoming the smoking habit. Most programs aim at gradually reducing a smoker's consumption of cigarettes or urging the smoker to switch to low tar and nicotine brands to gradually reduce the smoker's physical addiction to the cigarettes. However, these methods do not remove the smoker's psychological need or desire for cigarettes. Attempts to overcome the smoker's psychological addiction to cigarettes, such as hypnosis or making the smoker aware of the dangers and negative aspects of smoking, usually result in short term success. The smoker may quit for a few weeks or months, but usually resumes smoking with the same intensity that he or she had before treatment.

The basic problem with prior art devices and programs designed to discourage people from smoking is that they do not remove the positive aspects of smoking. In most cases, the smoker enjoys smoking and finds it to be a happy experience for various reasons. The smoker may enjoy the aroma of a tobacco; smoking may provide a sense of well being, or reduce anxiety. As long as the smoker enjoys some aspect of smoking, there is very little incentive to stop.

It is, therefore, an outstanding object of the invention to provide the means whereby smoking becomes an unpleasant experience.

Another object of this invention is the provision of means whereby the smoker is conditioned to dislike smoking by exposing him to an unpleasant smell or odor while smoking cigarettes.

A further object of the invention is the provision of a package of cigarettes in which at least some of the cigarettes contain a substance having an unpleasantodor.

It is another object of the instant invention to provide means for treating a package of cigarettes with an unpleasant odiferous substance.

A still further object of the invention is the provision of a device for treating a package of cigarettes in such a way that only a certain part of the cigarette will contain unpleasant odiferous substances and the part of the cigarette that contains such substance varies from cigarette-to-cigarette in the package.

A further object of the invention is to provide a device for treating a package of cigarettes with an unpleasant odiferous substance, which device also functions as a carrying case for the cigarette package.

It is a further object of the invention to provide a device for treating a package of cigarettes with an unpleasant odiferous substance, which device contains sufficient substance for several cigarette packages and can be easily refilled with said substance.

It is a further object of the invention to provide a device for treating a package of cigarettes with an unpleasant odiferous substance in which the substance is transferred to at least some of the cigarettes in the package by simply inserting a cigarette package into the device.

With these and other objects in view, as will be apparent to those skilled in the art, the invention resides in the combination of parts set forth in the specification and covered by the claims appended hereto.

SUMMARY OF THE INVENTION

In general, the invention consists of a package of cigarettes containing a plurality of cigarettes treated with an unpleasant odiferous substance interspersed with a plurality of untreated cigarettes. The invention also resides in a device for treating a package of cigarettes with the unpleasant odiferous substance, the device comprising a hollow carrying case divided into an upper compartment for receiving the package of cigarettes and a lower compartment containing the odiferous substance. A partition separates the upper and lower compartments and hollow needles extend from the lower compartment into the upper compartment for penetrating the cigarettes as the package is inserted into the upper compartment. This allows the substance to pass from the lower chamber into each cigarette penetrated by a needle. More specifically, there are fewer needles than cigarettes in the package. The needles are arranged in an irregular pattern and have different lengths, so that the cigarettes in the treated cigarette package are located in the package in a regular pattern and the portions of the cigarettes that are treated vary from cigarette-to-cigarette. After treatment, the cigarette package may remain in the carrying case or may be removed, as desired.

BRIEF DESCRIPTION OF THE DRAWINGS

The character of the invention, however, may be best understood by reference to one of its structural forms, as illustrated by the accompanying drawings, in which:

FIG. 4 is a fragmentary perspective view showing a typical irregular needle pattern, FIG. 5 is an enlarged fragmentary view of one of the needles in the carrying case, and FIG. 6 is a diagrammatic exploded view of a package of cigarettes treated with an unpleasant odiferous substance in accordance with the present invention.

DESCRIPTION OF THE PREFERRED EMBODIMENT

Figure 1:
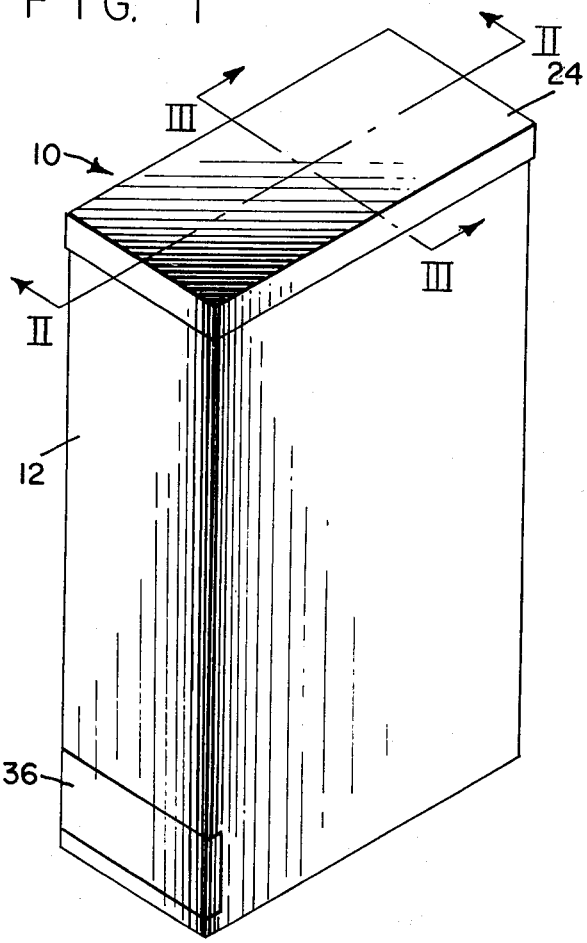
FIG. 1 is a perspective view of the carrying case embodying the principles of the present invention.
Figure 2:
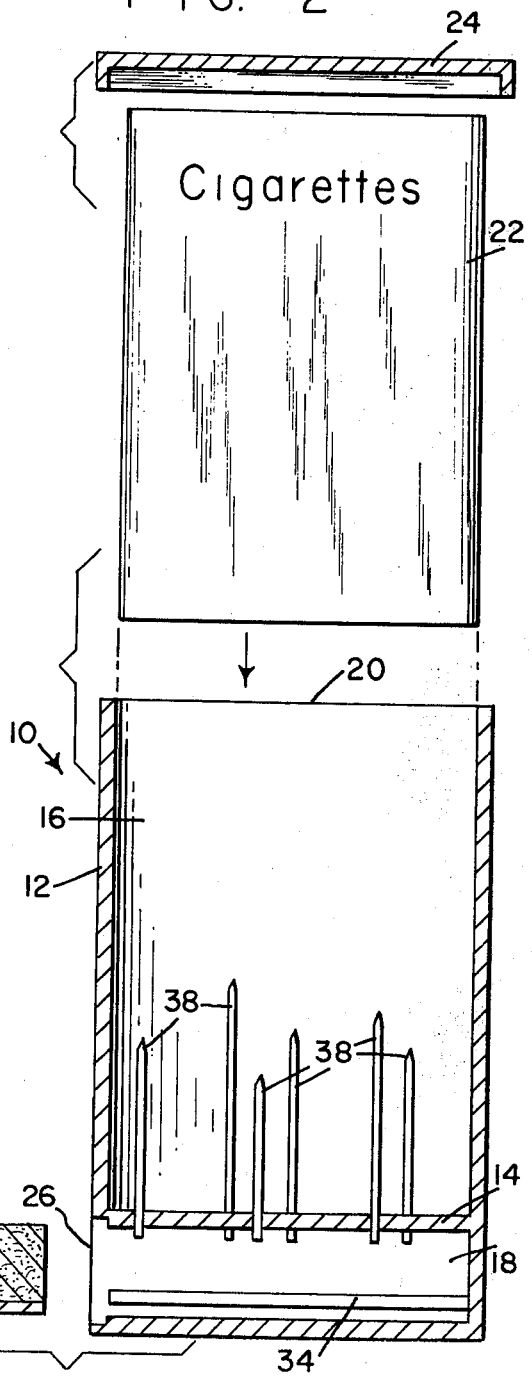
FIG. 2 is an exploded view, showing the carrying case in vertical cross-section along line II—II of FIG. 1.
Figure 3:
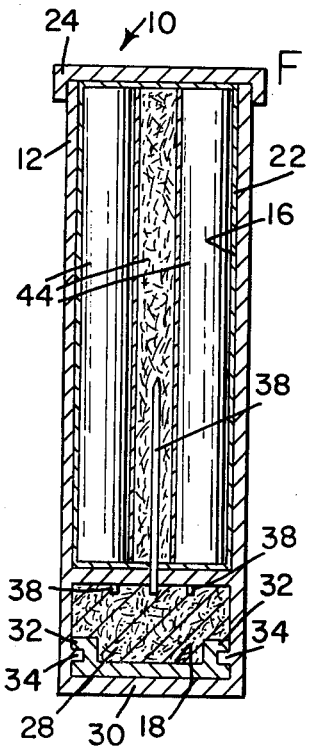
FIG. 3 is a vertical sectional view of the carrying case along line III—III of FIG. 1.
Figure 3:
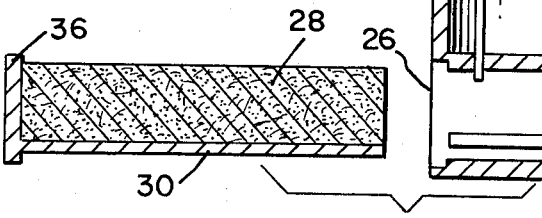

Referring to FIGS. 1–3, the anti-smoking device of the present invention is generally indicated by reference numeral 10 and comprises a hollow carrying case 12 provided with a horizontal partition 14 dividing the carrying case into an upper chamber 16 and a lower chamber 18. The upper chamber 16 has a top opening 20 for receiving a package of cigarettes 22. A top cover 24 is provided for closing the opening 20 after insertion of the cigarette package. The lower chamber 18 is provided with a lower opening 26 for receiving a quantity of absorbing material such as foam rubber or felt containing an unpleasant odiferous substance such as valiric acid which smells like vomit. The absorbing material 28 is supported on a tray or base 30 provided with a horizontal groove 32 on each side, (see FIG. 3), for sliding engagement with a pair of horizontal rails along the walls of the lower chamber 18. The tray 30 is also provided with an integral lower cover 36 for closing the opening 26 upon insertion of the absorbing material 28 into the lower chamber 18.

Referring particularly to FIGS. 2–5, a plurality of hollow needles extend from lower chamber 18 into the upper chamber 16. As shown in FIG. 5, each needle has an opening 40 at the bottom and one or more apertures 42 at the top. The top of each needle is preferaly pointed to failitate penetration of the needle into individual cigarettes 44 of the package 22, as the package is inserted into the upper chamber 16 as shown in FIG. 3. The hollow needles enable the odiferous substance to pass from the absorbing material 28 to the area of the cigarette surrounding the apertures 42.

Referring particularly to FIG. 4, it can be seen that the needles vary in height and are arranged in an irregular pattern with respect to the partition 14. Also, the number of needles is less than the number of cigarettes in a typical package of cigarettes. For example, the average package of cigarettes contains 20 cigarettes and there are 10 needles shown in FIG. 4. The needles are arranged in three separate rows X, Y, and D which correspond to the three rows of cigarettes in a typical cigarette package. Each row contains a few needles arranged in vertical alignment with individual cigarettes in the package. However, the invention is not limited to any particular number of needles or any particular arrangement of the needles. The three rows of needles, X, Y, and Z correlate with the three rows of cigarettes in the package indicated as rows A, B, and C in FIG. 6.

The operation and advantages of the present invention will now be readily understood in view of the above description. The carrying case 12 is prepared by removing the tray 30 from the chamber 18 and saturating the absorbing material 28 with the unpleasant, odiferous, or foul-smelling substance and reinserting the tray and absorbing material into the lower chamber 18. The package of cigarettes 22 to be treated is inserted into the upper chamber 16, so that a certain number of cigarettes in the package are penetrated by the needles 38. The opening 20 is then closed by cover 24. After a specified period of time, during which the odiferous substance has been allowed to pass from the material 28 into each cigarette penetrated by a needle, the package of cigarettes is considered treated and ready for use. The package of treated cigarettes may be left in the case or removed and carried in the user's pocket or in any conventional manner.

As shown in FIG. 6, some of the cigarettes in the treated package indicated at 44*a* contain the odiferous substance in the areas between dotted lines 46. The remaining cigarettes in the package, indicated at 44*b* do not contain the odiferous substance and, are therefore, untreated. As shown in FIG. 6, the treated and untreated cigarettes are dispersed within the package in an irregular pattern and the location of the odiferous substance in the treated cigarettes vary from cigarette-to-cigarette. During use, the smoker, when selecting a cigarette from the package, does not know if the cigarette contains a foul-smelling substance and if he does select a treated cigarette he does not know at which point the cigarette will begin to smell. The smell and the uncertainty associated with the use of the present invention, has a psychological effect, discouraging the smoker from smoking.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A device for use with a package of cigarettes to discourage the user from smoking, comprising:

(a) a hollow carrying case, having an opening at the top, (b) a partition dividing the interior of the carrying case into an upper chamber for receiving a package of cigarettes through said opening so that the bottom of the package rests against the partition, and a lower chamber containing an unpleasant odiferous substance, (c) a plurality of hollow needles extending from the lower chambers into the upper chamber, the needles being arranged to penetrate at least some of the cigarettes in the cigarette package as said package is inserted into the upper chamber, the upper and lower ends of each needle having an opening, whereby said odiferous substance is allowed to pass from the lower chamber into each cigarette penetrated by a needle.

2. A device as recited in claim 1, wherein the number of needles is less than the number of cigarettes.

3. A device as recited in claim 2, wherein the needles are arranged in an irregular pattern.

4. A device as recited in claim 1, wherein the needles vary in length.

5. A device as recited in claim 1, wherein the needles have pointed tops.

6. A device as recited in claim 1, wherein a material capable of absorbing said substance is located in said lower chamber for containing said odiferous substance.

7. A device as recited in claim 6, wherein the lower portion of said case is provided with a lower opening into the chamber for insertion and removal of said absorbing material, and a cover for closing the lower opening.

8. A device as recited in claim 7, wherein said absorbing material is mounted on a supporting base.

9. A device as recited in claim 8, wherein said lower chamber is provided with guideways and said base is constructed for sliding relationship on the guideways.

10. A device as recited in claim 8, wherein said cover is integrally formed with the base.

11. A device as recited in claim 1, comprising a top cover for the opening at the top of the upper chamber.

12. A device as recited in claim 1, wherein said odiferous substance is valiric acit.

* * * * *